US010113225B2

(12) United States Patent
Murphy et al.

(10) Patent No.: US 10,113,225 B2
(45) Date of Patent: Oct. 30, 2018

(54) MASKANT FOR USE IN ALUMINIZING A TURBINE COMPONENT

(71) Applicant: Howmet Corporation, Whitehall, MI (US)

(72) Inventors: Kenneth S. Murphy, Norton Shores, MI (US); William C. Basta, Montague, MI (US); Vincent J. Russo, Orange, CT (US)

(73) Assignee: Howmet Corporation, Whitehall, MI (US)

( * ) Notice: Subject to any disclaimer, the term of this patent is extended or adjusted under 35 U.S.C. 154(b) by 343 days.

(21) Appl. No.: 13/999,608

(22) Filed: Mar. 12, 2014

(65) Prior Publication Data

US 2014/0287143 A1 Sep. 25, 2014

Related U.S. Application Data

(60) Provisional application No. 61/851,746, filed on Mar. 13, 2013.

(51) Int. Cl.

| | |
|---|---|
| ***C23C 10/08*** | (2006.01) |
| ***C23C 10/04*** | (2006.01) |
| ***C23C 10/32*** | (2006.01) |
| ***C23C 10/38*** | (2006.01) |
| *F01D 5/28* | (2006.01) |
| *F01D 5/30* | (2006.01) |

(52) U.S. Cl.

CPC ..... *C23C 10/04* (2013.01); *C23C 10/08* (2013.01); *C23C 10/32* (2013.01); *C23C 10/38* (2013.01); *F01D 5/288* (2013.01); *F01D 5/3092* (2013.01); *F05D 2230/31* (2013.01)

(58) Field of Classification Search

CPC ..... C23C 16/06; C23C 16/08; C23C 16/12; C23C 16/18; C23C 16/20; C23C 10/04; C23C 10/32; C23C 10/56

USPC ..... 427/252

See application file for complete search history.

(56) References Cited

U.S. PATENT DOCUMENTS

| | | | | |
|---|---|---|---|---|
| 3,801,357 A | | 4/1974 | Baldi | 117/107.2 |
| 3,958,047 A | | 5/1976 | Baldi | 427/252 |
| RE29,212 E | | 5/1977 | Baldi | 427/253 |
| 4,041,196 A | | 8/1977 | Baldi | 427/252 |
| 4,181,758 A | | 1/1980 | Elam | 427/253 |
| 4,347,267 A | | 8/1982 | Baldi | 427/237 |
| 4,464,430 A | | 8/1984 | Baldi | 428/201 |
| 4,617,202 A | * | 10/1986 | Baldi | 427/253 |

(Continued)

FOREIGN PATENT DOCUMENTS

| | | |
|---|---|---|
| GB | 2 401 117 | 3/2004 |
| JP | 2002-540296 A | 11/2002 |
| WO | 2006/061431 | 6/2006 |

*Primary Examiner* — Elizabeth A Burkhart

(74) *Attorney, Agent, or Firm* — Greenberg Traurig, LLP

(57) ABSTRACT

A mask is used in aluminizing of superalloy turbine component, such as a turbine blade, where a region exposed to relatively high operating temperature is aluminized to form a diffusion aluminide coating and another region exposed to relatively lower operating temperatures is masked to prevent aluminizing of the masked region while concurrently being enriched in Cr and/or retaining a pre-existing Cr-content from the superalloy chemistry itself or from a previous chromizing operation.

17 Claims, 2 Drawing Sheets

(56) References Cited

U.S. PATENT DOCUMENTS

| | | | | | |
|---|---|---|---|---|---|
| 4,820,362 | A * | 4/1989 | Baldi | B65D 43/022 149/109.6 |
| 4,845,139 | A * | 7/1989 | Baldi | 524/407 |
| 5,128,179 | A | 7/1992 | Baldi | 427/252 |
| 5,182,078 | A | 1/1993 | Baldi | 419/9 |
| 5,261,963 | A | 11/1993 | Basta | 118/724 |
| 5,264,245 | A | 11/1993 | Punola | 427/237 |
| 5,407,704 | A | 4/1995 | Basta | 427/248.1 |
| 5,462,013 | A | 10/1995 | Punola | 118/719 |
| 5,464,699 | A | 11/1995 | Baldi | 428/607 |
| 5,523,165 | A * | 6/1996 | Walter et al. | 428/469 |
| 5,725,905 | A | 3/1998 | Walter | 427/156 |
| 6,283,715 | B1 | 9/2001 | Nagaraj | 416/241 |
| 6,521,294 | B2 | 2/2003 | Rigney | 427/253 |
| 6,730,179 | B2 | 5/2004 | Kircher | 148/240 |
| 6,863,927 | B2 | 3/2005 | Langley | 427/252 |
| 6,924,038 | B1 | 8/2005 | Hardy | 428/446 |
| 7,824,738 | B2 | 11/2010 | Smith | 427/383.1 |
| 2005/0191421 | A1 | 9/2005 | Berndt | 427/282 |
| 2008/0057189 | A1 * | 3/2008 | Smith et al. | 427/182 |
| 2010/0124670 | A1 * | 5/2010 | Tolpygo | C23C 10/02 428/678 |
| 2010/0266409 | A1 | 10/2010 | Chandra | 416/95 |
| 2011/0135947 | A1 | 6/2011 | Berndt | 428/450 |

* cited by examiner

MASKANT FOR USE IN ALUMINIZING A TURBINE COMPONENT

RELATED APPLICATION

This application claims benefit and priority of U.S. provisional application Ser. No. 61/851,746 filed Mar. 13, 2013, the disclosure of which is incorporated herein by reference.

FIELD OF THE INVENTION

The present invention relates to coating of turbine components, such as turbine blades, where a region exposed to relatively high operating temperature is aluminized and another region exposed to relatively lower operating temperatures is masked to prevent aluminizing while concurrently being enriched in Cr and/or retaining a pre-existing Cr content.

BACKGROUND OF THE INVENTION

Gas turbine engine superalloy turbine blades and/or turbine vanes are coated in the airfoil region and sometimes in the platform region and even the shank of the root region with a simple or Pt-modified diffusion aluminide coating to provide a bond coat for thermal barrier ceramic coating, protection against deterioration by high temperature oxidation, or mild salt promoted corrosion processes that occur at the operating temperature experienced during use. Formation of the diffusion aluminide coating is accompanied by dimensional growth which can be tolerated in the those regions of the turbine blade/vane.

However, the fir tree region or other attachment region of the superalloy turbine blade or vane cannot tolerate such dimensional growth since it may exceed the dimensional tolerance of fitting/mating surfaces leading to assembly problems and possible mechanical failure in highly stressed attachment regions, e.g. fir tree roots. Chromizing of the fir tree region or other attachment region portion concurrently with aluminizing of the other regions of the turbine blade/vane has been attempted to protect the fir tree region or other attachment region from lower temperature corrosion without experiencing unwanted dimensional growth there. In one known method, a first mask comprising chromising composition is arranged on the selected region of the superalloy turbine component and an aluminising mask is arranged on the chromising composition.

The chromising composition comprises chromium powder, ferrochrome powder or other chromium containing powder, an inert refractory diluent powder, and a halide activator mixed with binder to form a slurry that is applied to the region to be coated. The first mask is covered by a second mask comprising an aluminizing mask, which can be a slurry coating or alternatively a particle-filled making box. The second mask comprises nickel powder, nickel oxide powder or nickel alloy powder, refractory powder such as alumina, and an inorganic resin binder.

SUMMARY OF THE INVENTION

The present invention provides a mask for use in aluminizing of a superalloy turbine component, such as a turbine blade, where a region exposed to relatively high operating temperature is aluminized to form a diffusion aluminide coating and another region exposed to relatively lower operating temperatures is masked to prevent aluminizing while concurrently providing Cr enrichment and/or retention of a pre-existing Cr-content from the superalloy chemistry itself or from a previous chromizing operation.

One embodiment of the invention provides a Cr-modified mask that comprises intentionally-added Cr-containing powder, nickel-containing powder, and refractory powder such as alumina wherein the Cr-containing powder is present in the mask in an amount that provides a Cr chemical activity that is greater than the Cr chemical activity of the turbine component superalloy to be coated or a pre-existing Cr enrichment. For Cr enrichment without alpha Cr layer formation, the Cr content of the Cr-containing powder typically does not exceed about 25 weight % based on the weight of the mask. For purposes of illustration and not limitation, for coating CMSX-4® superalloy having nominally 6.5 weight % Cr, the mask will have a Cr content greater than 10 weight % and typically less than about 25 weight %. The mask is useful for CVD or above-the-pack aluminizing at a temperature of about 1050 C or less for a time of about 8 hours or less.

In one method embodiment of the invention, the turbine component to be coated is positioned in a coating chamber in a manner that at least a portion of the root region is covered by the mask and other regions to be aluminized is/are exposed to a gaseous aluminizing atmosphere in the chamber to form a diffusion aluminide coating on those regions. Concurrently, the masked portion is enriched in Cr, or an existing Cr content there is retained. For example, the coating temperature and coating time can be about 1050 C or for a time of about 8 hours or less.

Another embodiment of the invention provides a multi-mask system having an inner mask and outer mask on the inner mask. The inner mask comprises substantially pure Cr powder or Cr-containing alloy powder in direct contact with the surface to be coated. The outer mask comprises the Cr-modified mask described above. The multi-mask system is useful for CVD or above-the-pack aluminizing at a relatively higher temperature above about 1050 C for a time greater than about 8 hours.

In another method embodiment of the invention, the turbine component to be coated is positioned in a coating chamber in a manner that at least a portion of the root region is covered by the inner mask and the outer mask on the inner mask and other regions to be aluminized is/are exposed to an aluminizing atmosphere in the chamber to form a diffusion aluminde on those regions. Concurrently, the masked portion is enriched in Cr, or an existing Cr content there is retained. The coating temperature and coating time can be above about 1050 C for a time greater than about 8 hours.

Advantages and other features of the invention will become more apparent from the following detailed description taken with the following drawings.

DETAILED DESCRIPTION OF THE INVENTION

Single Mask System

Figure 1:
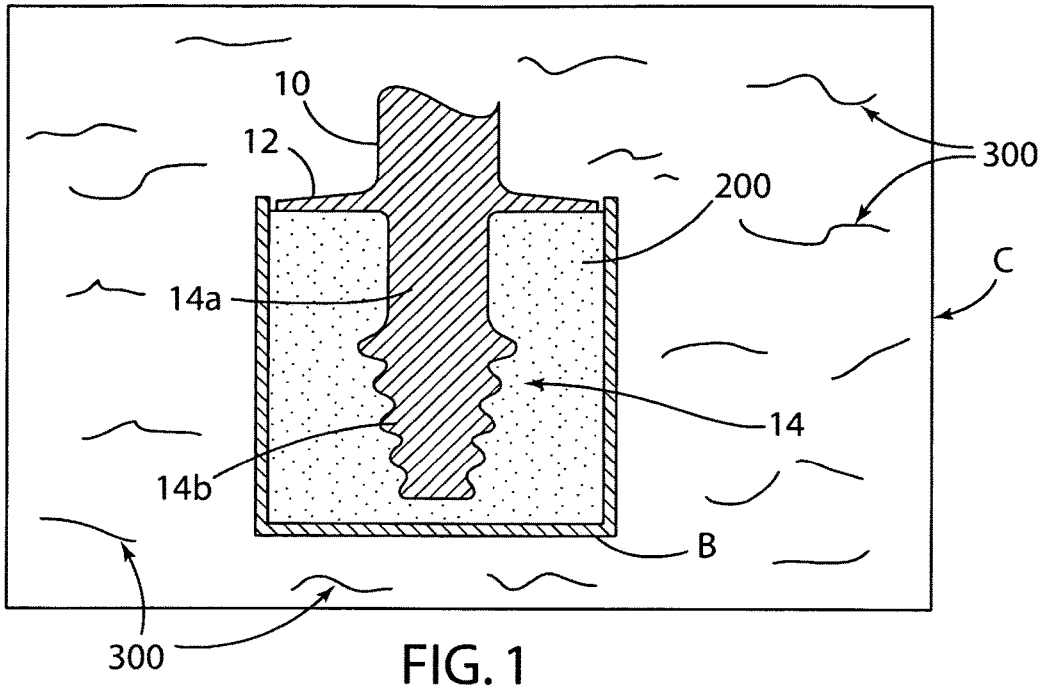
FIG. 1 is a schematic cross-sectional view of a turbine blade having an airfoil region and upper surface of the platform region exposed to an aluminizing gaseous atmosphere while a root region and lower platform surface are masked using a single mask to prevent aluminizing while concurrently being enriched in Cr and/or retaining a pre-existing Cr-content.

One embodiment of the invention provides a Cr-modified mask for use in aluminizing of a turbine component region at a relatively lower temperature and shorter time. For purposes of illustration and not limitation, the Cr-modified mask 200, FIG. 1, is useful for CVD or above-the-pack aluminizing at a temperature of about 1050° C. or less for a time of about 8 hours or less. The turbine component can be made of a Ni base superalloy, a Co base superalloy, or a Fe base superalloy, which are well known in the art. In the description below, CMSX-4® is described and has a nominal composition of 6.5Cr-9Co-0.6Mo-6W-6.5Ta-3Re-5.6Al-1Ti-0.1Hf-balance Ni.

The Cr-modified mask comprises a powder composition that includes intentionally-added Cr-containing powder together with Ni-containing powder, and refractory powder such as alumina or other refractory materials. The Cr-containing powder can comprise a metallic Cr powder (e.g. −325 mesh powder) and/or a Cr-containing alloy powder (e.g. 30 weight % Cr-balance Ni powder) of similar particle size. The Ni-containing powder can comprise metallic Ni powder, a Ni alloy powder, and/or nickel oxide powder.

In an illustrative embodiment of the invention, the mask can comprise a commercially available M1 maskant available from Akron Paint and Varnish, Akron, Ohio (also known as APV Engineered Coatings) to which the Cr-containing powder is added and mixed. An exemplary maskant useful in practicing the invention into which Cr-containing powder (nominal particle size of about 5 to about 10 microns) can be mixed can comprise alumina powder (nominal particle size 0.5 to 15 microns) and a nickel alloy powder wherein the nickel alloy powder is present in an amount of about 15 to about 35 volume %, preferably about 22 to about 27 volume %, and the balance is the alumina powder and wherein the nickel alloy powder (nominal particle size of 1 to 10 microns) comprises about 15 to about 20 weight % Al and 0 to about 4 weight % Cr, and balance Ni, preferably 16 to 17 weight % Al and 1.5 to 2.5 weight % Cr and balance Ni.

The Cr-containing powder is provided in the M1 maskant in an amount that provides a Cr chemical activity that is greater than the Cr chemical activity of the turbine component alloy to be coated or of a pre-existing Cr enrichment from a previous chromizing operation wherein the more Cr in the turbine component alloy, the more Cr that is used in the mask to increase the Cr surface enrichment of the alloy. The Cr content of the Cr-containing powder is controlled to this end to drive Cr into the surface of the component alloy to form a Cr-enriched surface layer on the superalloy, or to maintain a pre-existing Cr enrichment at the surface layer of the superalloy by supplying Cr to a pre-existing Cr-enriched surface layer formed by a prior chromizing operation to counteract loss of Cr which occurs during the aluminizing operation when the aforementioned commercially available M1 maskant is used without modification. For Cr surface enrichment without alpha Cr layer formation, the Cr content of the Cr-containing powder typically does not exceed about 25 to about 30 weight % based on the weight of the mask. Higher than 25 weight % of pure Cr can be used, but the resulting Cr content of the surface enrichment will reach saturation (the α-Cr phase) at less than 25 weight % Cr. As a result, Cr contents of the mask of about 25 to about 30 weight % can produce a thin continuous to a thick amount of alpha Cr layer on the alloy with Cr enrichment beneath the alpha Cr layer of the alloy (substrate). Using a Cr—Ni or Cr—Fe alloy powder may require greater than 25 weight % Cr to reach formation of the α-Cr phase layer. For purposes of illustration and not limitation, for coating CMSX-4® superalloy having nominally 6.5 weight Cr, the Cr-modified mask will have a Cr content greater than 10 weight % and less than about 25 weight %. The Cr-modified mask is useful alone for masking a selected region of the turbine component for gas phase aluminizing such as by CVD (chemical vapor deposition) or by above-the-pack aluminizing at a temperature of about 1050° C. or less for a time of about 8 hours or less.

In one method embodiment of the invention, a turbine component to be coated is positioned in a coating chamber to form a diffusion aluminide coating on one region while another region is covered by the Cr-modified mask. For purposes of illustration and not limitation, referring to FIG. 1, a turbine blade is shown having an airfoil region 10, a platform region 12, and a root region 14, which comprises a shank region **14*a* and a fir tree (or other attachment) region 14*b*. The airfoil region 10 and the upper surface of the platform region 12 are to be aluminized to form a simple or Pt-modified diffusion aluminide coating thereon. To this end, these regions are exposed to aluminizing coating gas mixture 300** such as Ar, $H_2$, and aluminum halides (chlorides) gases, in the retort coating chamber C as is well known e.g. as described in U.S. Pat. Nos. 5,261,963; 5,264,245; 5,407,704; and 5,462,013, the teachings of which are incorporated herein by reference. An illustrative relatively low aluminizing temperature is 1010° C. for 7 hours.

To this end, the turbine blade is shown with its root end located in a masking box B having the Cr-modified powder mask 200 pursuant to the invention therein while leaving the airfoil region 10 and the upper surface of the platform region 12 exposed to the gaseous aluminizing atmosphere. In FIG. 1, the root region 14 including its shank region **14*a* and fir tree region 14*b* are masked as also is the lower surface of the platform 12 to prevent aluminizing there while the masked surfaces are concurrently being enriched in Cr and/or retaining a pre-existing Cr-content provided by the superalloy Cr chemistry (content) itself or by a previous chromizing operation. To this end, the Cr content of the Cr-modified mask pursuant to the invention can be controlled to produce an enrichment of the masked surfaces in Cr, or to maintain a pre-existing Cr content of the masked surfaces provided by the superalloy chemistry itself or by a previous chromizing operation. Typically, the Cr content of the mask for aluminizing CMSX-4® single crystal turbine blade (substrate) component is about 15 weight % to about 20 weight % based on the weight of the mask. Control of the Cr chemical activity of the mask 200** can be employed to provide Cr solid solution enrichment of the superalloy surface while avoiding, if desired, alpha Cr phase grown outwardly from the surface.

After the aluminizing operation, the turbine blade is removed from the masking box B and residual mask material is cleaned off, taking care not damage the Cr enriched surface and/or the pre-existing Cr enriched surface which is retained as a result of appropriate selection of the Cr content of the mask.

Although FIG. 1 illustrates masking of the entire root region 14 and the underside of the platform 12, the invention is not so limited. For example, only the fir tree region 14*b* can be masked such that the fir tree region 14*b* has a Cr-enriched surface or retains a pre-existing Cr content while the underside of the platform 12 and the shank regions 14*a* are aluminized along with the airfoil region 10.

Multi-Mask System

Another embodiment of the invention provides a multi-mask system having an inner mask 100 and outer mask 200 on the inner mask for use in aluminizing a turbine component region at relatively higher temperature of greater than about 1050° C. for times of more than about 8 hours. The inner (first) mask 100 comprises substantially pure Cr powder (e.g. −325 mesh Cr powder) or Cr-containing alloy powder (e.g. 30 weight % Cr-balance Ni powder) of similar particle size in direct contact with the surface to be coated. The first mask does not include an intentionally-added activator in it. Typically, the Cr-containing powder is mixed with a binder comprising water and polyvinyl alcohol to provide a slurry that can be applied to the region to be masked by dipping, brushing, spraying and other application techniques.

The outer (second) mask 200 comprises the Cr-modified mask 200 described above for the single mask system or other maskant.

In another method embodiment of the invention, a turbine component to be coated is positioned in a coating chamber to form a diffusion aluminide coating on one region while another region is covered by the two part mask system. For purposes of illustration and not limitation, referring to FIG. 2, a turbine blade is shown having an airfoil region 10, a platform region 12, and a root region 14, which comprises a shank region 14*a* and a fir tree (or other attachment) region 14*b*. The airfoil region 10 and the upper surface of the platform region 12 are to be aluminized to form a simple or Pt-modified diffusion aluminide coating thereon. To this end, these regions are exposed to aluminizing coating gas (es) 300, such as Ar, $H_2$, and aluminum halide gases, in the retort coating chamber C as is well known e.g. as described in U.S. Pat. Nos. 5,261,963; 5,264,245; 5,407,704; and 5,462,013, the teachings of which are incorporated herein by reference. An illustrative relatively higher aluminizing temperature is 1080° C. for 24 hours using CVD coating gas mixture 300 of argon, hydrogen and aluminum chlorides to aluminize surfaces, such as surfaces of airfoil 10 and upper surface of platform 12 while Cr-containing layers 100 and 200 produce the alpha Cr layer and underlying Cr enrichment in the surface of the CMSX-4® superalloy surface as depicted in the composition depth profile of FIG. 3.

Figure 2:
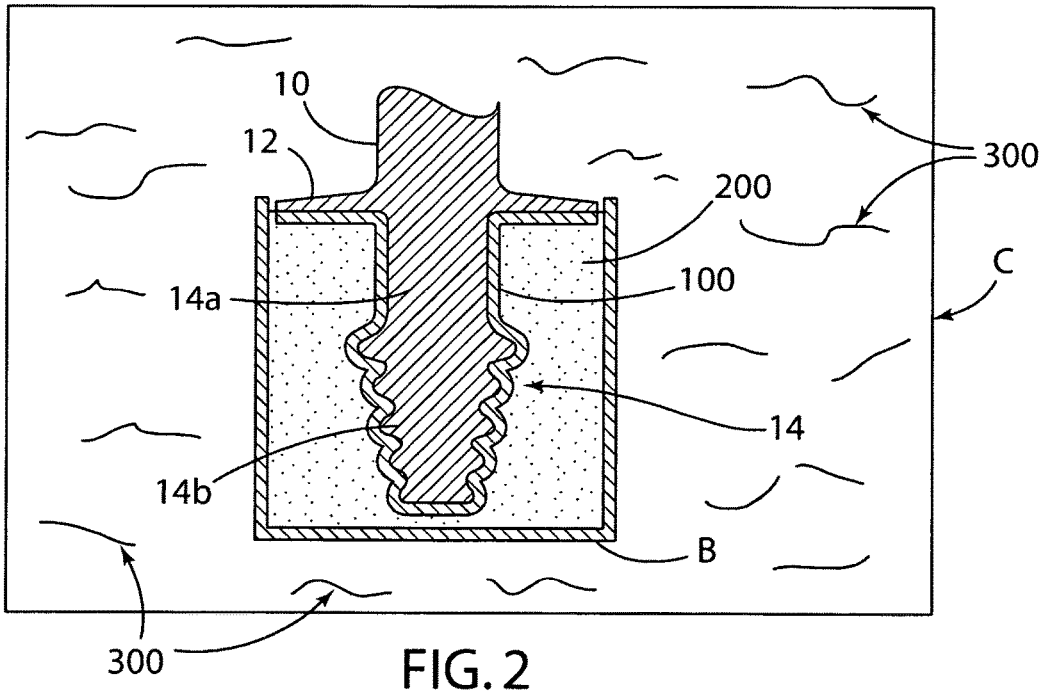
FIG. 2 is a schematic cross-sectional view of a turbine blade having an airfoil region and upper surface of the platform region exposed to an aluminizing gaseous atmosphere while a root region and lower platform surface are masked using inner and outer masks to prevent aluminizing while concurrently being enriched in Cr and/or retaining a pre-existing Cr-content.
Figure 3:
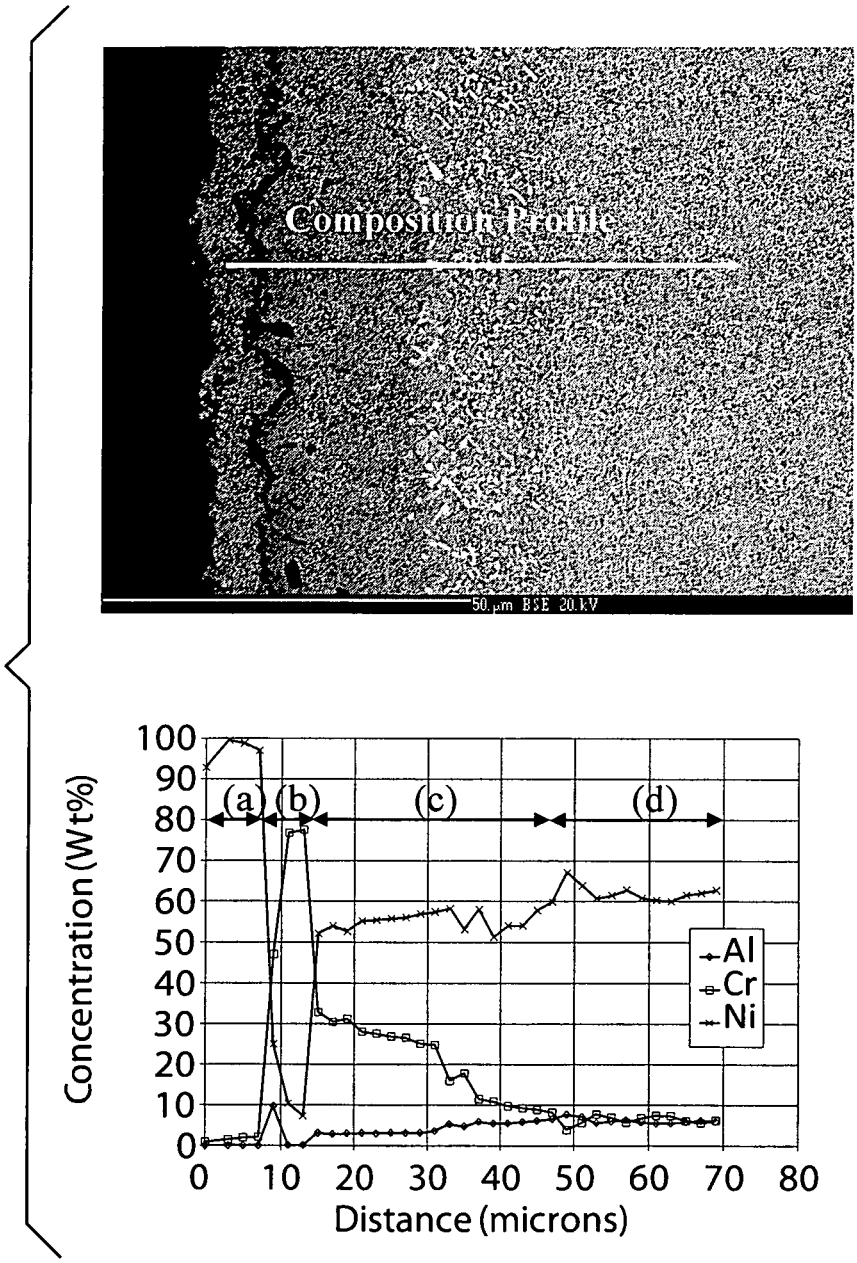
FIG. 3 is a composition depth profile and corresponding photomicrograph of Cr enrichment into the surface of CMSX-4® superalloy surface produced by use of the multi-mask as in FIG. 2 by aluminizing at 1080 C for 24 hours. The composition versus depth profile of FIG. 3 shows the following regions: (a) metallographic plating, (b) α-Cr phase, (c) Cr solid solution enrichment, and (d) CMSX-4® superalloy.

To this end, the turbine blade is shown with its masked root end located in a masking box B having the Cr-modified mask therein while leaving the airfoil region 10 and the upper surface of the platform region 12 exposed to the gaseous aluminizing atmosphere. In FIG. 2, the root region 14 including its shank region 14*a* and fir tree region 14*b* include the two part mask system as does the lower surface of the platform 12 to prevent aluminizing there while the masked surfaces are concurrently being enriched in Cr and/or retaining a pre-existing Cr-content provided by the superalloy Cr chemistry (content) itself or by a previous chromizing operation. The inner mask 100 is applied by dipping the underside of the platform region 12 and the root region in a slurry made by mixing the substantially pure Cr powder or Cr-containing alloy powder in a liquid binder such as water and polyvinyl alcohol to apply a mask layer. The second part of the mask system is provided by the Cr-modified mask powder present in the masking box B as shown in FIG. 2. The collective Cr content of the inner mask 100 and the Cr-modified mask 200 pursuant to the multi-mask system of the invention can be controlled to produce an α-Cr phase if desired.

After the aluminizing operation, the turbine blade is removed from the masking box B and residual mask material is cleaned off taking care not damage the Cr enriched surface and/or any pre-existing Cr enriched surface which is retained as a result of appropriate selection of the Cr content of the mask.

Although the invention has been described in connection with certain illustrative embodiments, those skilled in the art will appreciate that modifications and changes can be made therein with the scope of the invention as set forth in the appended claims.

We claim:

1. A mask for preventing aluminizing of a region of a component made of a superalloy, comprising a mixture of chromium-containing powder, nickel-containing powder and refractory powder wherein the chromium-containing powder comprises metallic chromium powder or chromium-containing metal alloy powder, the chromium-containing powder being present in the mixture in an amount greater than about 10 weight % effective (a) to supply chromium to form a chromium-enriched surface on the superalloy component beneath the mask during aluminizing of an unmasked region or (b) to supply chromium to a pre-existing chromium-enriched chromized surface on the superalloy component beneath the mask to retain the chromium-enriched chromized surface during aluminizing of an unmasked region.

2. The mask of claim 1 wherein the chromium-containing metal alloy powder comprises an alloy of Cr and a transition metal.

3. The mask of claim 1 wherein the chromium-containing powder is present in the mask in an amount to provide a Cr chemical activity in the mask that is greater than the Cr activity of the superalloy or of the pre-existing Cr-enriched chromized surface.

4. The mask of claim 1 wherein the Cr content is less than about 25 weight % of the weight of the mixture.

5. A method of aluminizing a nickel base superalloy component, comprising masking a region of the component with the mask of claim 1 and exposing an unmasked region to a gaseous aluminizing atmosphere to form a diffusion aluminide coating thereon while (a) forming the chromium-enriched surface beneath the mask during aluminizing of the unmasked region or (b) retaining the chromium-enriched chromized surface beneath the mask during aluminizing of the unmasked region.

6. The method of claim 5 wherein the mask forms the chromium-enriched surface that comprises alpha chromium phase.

7. The method of claim 6 wherein the chromium-enriched surface comprises a layer of the alpha chromium phase and an underlying zone enriched in solid solution chromium beneath the layer.

8. The method of claim 5 wherein the mask forms the chromium-enriched surface that comprises a solid solution chromium-enriched zone on the superalloy component.

9. A mask for preventing aluminizing of a region of a component made of a superalloy, comprising an inner mask comprising metallic chromium powder or chromium-containing metal alloy powder and an outer mask on the inner mask wherein the outer mask comprises a mixture of chromium-containing powder, nickel-containing powder, and refractory powder and wherein the chromium-containing powder of the outer mask comprises metallic chromium powder or chromium-containing metal alloy powder and wherein the collective amount of chromium in the inner mask and the outer mask is effective (a) to supply chromium to form a chromium-enriched surface on the superalloy component beneath the mask during aluminizing of an unmasked region or (b) to supply chromium to a pre-existing chromium-enriched chromized surface on the superalloy component beneath the mask to retain the chromium-enriched chromized surface during aluminizing of an unmasked region.

10. The mask of claim 9 wherein the Cr-containing metal alloy powder comprises an alloy of Cr and a transition metal.

11. The mask of claim 9 wherein the Cr content of the mixture of the outer mask is greater than 10 weight % of the weight of the mask.

12. The mask of claim 11 wherein the Cr content of the mixture of the outer mask is less than about 25 weight % of the weight of the mask.

13. The mask of claim 9 wherein the inner mask is free of activator and refractory powder.

14. A method of aluminizing a nickel base superalloy component, comprising masking a region of the component with the mask of claim 9 and exposing an unmasked region to a gaseous aluminizing atmosphere to form a diffusion aluminide coating thereon while (a) forming the chromium-enriched surface beneath the mask during aluminizing of the unmasked region or (b) retaining the chromium-enriched chromized surface beneath the mask during aluminizing of the unmasked region.

15. The method of claim 14 wherein the mask forms the chromium-enriched surface that comprises alpha chromium phase.

16. The method of claim 15 wherein the chromium-enriched surface comprises a layer of the alpha chromium phase and an underlying zone enriched in solid solution chromium beneath the layer.

17. The method of claim 14 wherein the mask forms the chromium-enriched surface that comprises a solid solution chromium-enriched zone on the superalloy component.

* * * * *